US006773088B2

(12) United States Patent
Aldrich et al.

(10) Patent No.: US 6,773,088 B2
(45) Date of Patent: Aug. 10, 2004

(54) DOUBLE LIPPED PRINTHEAD MAINTENANCE CAP

(75) Inventors: Charles Stanley Aldrich, Nicholasville, KY (US); James Marvin Jackson, Lexington, KY (US); Martin Alan Johnson, Winchester, KY (US); Herman Anthony Smith, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 13 days.

(21) Appl. No.: 10/295,690

(22) Filed: Nov. 15, 2002

(65) Prior Publication Data

US 2004/0095415 A1 May 20, 2004

(51) Int. Cl.[7] ..... B41J 2/165
(52) U.S. Cl. ..... 347/29
(58) Field of Search ..... 347/22, 29, 30, 347/32, 33

(56) References Cited

U.S. PATENT DOCUMENTS

| | | | | |
|---|---|---|---|---|
| 5,333,007 | A | 7/1994 | Kneezel et al. | 347/20 |
| 5,530,463 | A | 6/1996 | Nystrom et al. | 347/44 |
| 5,534,896 | A | 7/1996 | Osborne | 347/29 |
| 5,534,897 | A | 7/1996 | Anderson et al. | 347/32 |
| 5,563,637 | A | 10/1996 | Francis et al. | 347/32 |
| 5,619,232 | A | 4/1997 | Maeno | 347/30 |
| 5,627,573 | A | 5/1997 | Fahy | 347/32 |
| 5,661,510 | A | 8/1997 | Brandon et al. | 347/87 |
| 5,790,146 | A | 8/1998 | Anderson | 347/28 |
| 5,867,184 | A | 2/1999 | Quintana | 347/29 |
| 5,988,789 | A | 11/1999 | Nakahara | 347/32 |
| 6,007,177 | A | 12/1999 | Takanaka et al. | 347/28 |
| 6,042,216 | A | 3/2000 | Garcia et al. | 347/29 |
| 6,135,585 | A | 10/2000 | Johnson et al. | 347/32 |
| 6,139,129 | A | 10/2000 | Tabasso et al. | 347/33 |
| 6,145,968 | A | 11/2000 | Fries et al. | 347/85 |
| 6,209,983 | B1 * | 4/2001 | Osborne et al. | 347/32 |
| 6,220,689 | B1 | 4/2001 | Sturgeon | 347/29 |
| 6,299,299 | B1 | 10/2001 | Fries et al. | 347/86 |
| 6,398,338 | B1 | 6/2002 | Berg et al. | 347/32 |
| 6,422,681 | B1 | 7/2002 | Berg et al. | 347/32 |
| 6,447,094 | B1 | 9/2002 | Berg et al. | 347/22 |
| 2002/0008726 | A1 | 1/2002 | Tsuchiya et al. | 347/29 |
| 2002/0015070 | A1 | 2/2002 | Taylor et al. | 347/32 |
| 2002/0027580 | A1 | 3/2002 | Fries et al. | 347/84 |
| 2002/0126178 | A1 | 9/2002 | Toh et al. | 347/33 |

* cited by examiner

*Primary Examiner*—Shih-Wen Hsieh
(74) *Attorney, Agent, or Firm*—Taylor & Aust. P.C.

(57) ABSTRACT

A printhead maintenance cap includes a base and a wall portion. The wall portion is defined by a plurality of adjoining walls, and has a proximal end and a distal end, the plurality of adjoining walls defining an interior region. The proximal end is coupled to the base. A first lip extends from the distal end of the wall portion by a first extent in a direction non-orthogonal to the base, the first lip defining a first perimetrical sealing surface. A second lip extends from the distal end of the wall portion by a second extent, the second lip being spaced apart from the first lip, the second lip defining a second perimetrical sealing surface.

24 Claims, 5 Drawing Sheets

DOUBLE LIPPED PRINTHEAD MAINTENANCE CAP

BACKGROUND OF THE INVENTION

1. Field of the Invention

The present invention relates to an imaging apparatus, and, more particularly, to a printhead maintenance cap for an ink jet printer.

2. Description of the Related Art

In the printing arts, ink jet printers form an image on a print medium by selectively ejecting ink from one or more of a plurality of ink jet nozzles formed in a nozzle plate of an ink jet printhead. In order to maintain the printhead at an acceptable level of performance, ink jet printers typically include a maintenance station for performing scheduled maintenance operations and for providing a sealed environment for the printhead nozzle plate during periods of non-use.

One example of a maintenance station includes a movable maintenance sled including a printhead wiper and a printhead maintenance cap. The printhead wiper includes a blade edge for engaging the printhead nozzle plate to remove waste ink and contaminants that have accumulated on the printhead nozzle plate during printing. The cap is moved by the maintenance sled from a non-contact position with respect to the printhead to a contact position with respect to the printhead in an attempt to provide a sealed environment around the ink jet nozzles of the printhead.

Typically, the cap is formed as a generally rectangular structure defined by four adjoining walls that extend vertically upwardly from a base, and is made from an elastomer, with an upper portion of the four adjoining walls defining a single sealing lip. Commonly, the elastomer cap is placed over the nozzle plate of the printhead in an attempt to provide a sufficiently humid environment to avoid undesirable drying and crystallization of ink on the printhead that may plug ink jet nozzles. Such a cap attempts to form a leak-free seal between the printhead nozzles and the ambient environment. Conventionally, this has been done in one of two ways: by forcing the elastomer cap into the printhead with enough force to deform the cap around its scaling lip, or by providing a spring-loaded gimbaling mechanism behind the cap to allow the lip of the cap to "float" with the printhead. The former typically requires large forces to produce sufficient deformation to ensure a reliable seal, due to manufacturing tolerances. The latter typically requires less force, but adds a significant number of parts, thus increasing the cost and complexity of the cap mechanism.

As ink jet printing technology has evolved, the size of the ink jet printheads has been decreasing, while the size of the printhead nozzle plate containing the ink jetting nozzles and the number of ink jet nozzles in the nozzle plate has increased. As a result, the surface area on the printhead available for establishing an effective seal with the cap generally has diminished. Also, with the larger-sized nozzle plates and the advent of non-planar printhead topography in the regions surrounding the nozzle plate, it has become increasingly difficult to effect an acceptable degree of sealing around the nozzle plate.

What is needed in the art is a printhead maintenance cap having features to maintain an effective seal around the printhead nozzle plate and which may tend to reduce the amount of force required to effect capping.

SUMMARY OF THE INVENTION

The present invention provides a printhead maintenance cap having features to maintain an effective seal around the printhead nozzle plate and which may tend to reduce the amount of force required to effect capping.

The present invention, in one form thereof, is directed to a printhead maintenance cap. The printhead maintenance cap includes a base and a wall portion. The wall portion is defined by a plurality of adjoining walls, and has a proximal end and a distal end. The plurality of adjoining walls defines an interior region. The proximal end is coupled to the base. A first lip extends from the distal end of the wall portion by a first extent in a direction non-orthogonal to the base. The first lip defines a first perimetrical sealing surface. A second lip extends from the distal end of the wall portion by a second extent. The second lip is spaced apart from the first lip. The second lip defines a second perimetrical sealing surface.

In another form thereof, the present invention is directed to a printhead maintenance cap including a wall portion having a proximal end and a distal end, the wall portion defining an interior region. A first perimetrical lip extends from the distal end of the wall portion by a first extent, the first perimetrical lip defining a primary sealing surface. A second perimetrical lip extends from the distal end of the wall portion by a second extent, the second perimetrical lip being spaced apart from the first perimetrical lip, wherein a perimetrical valley is defined between the first perimetrical lip and the second perimetrical lip.

In yet another form thereof, the present invention is directed to an imaging apparatus including a printhead carrier, a printhead mounted to the printhead carrier, and a printhead maintenance station including a printhead maintenance cap and a moving mechanism coupled to the printhead maintenance cap for moving the printhead maintenance cap relative to the printhead. The printhead maintenance cap includes a base and a wall portion. The wall portion is defined by a plurality of adjoining walls, and has a proximal end and a distal end. The plurality of adjoining walls define an interior region. The proximal end is coupled to the base. A first lip extends from the distal end of the wall portion by a first extent in a direction non-orthogonal to the base, the first lip defining a first perimetrical sealing surface. A second lip extends from the distal end of the wall portion by a second extent, the second lip being spaced apart from the first lip. The second lip defines a second perimetrical sealing surface.

In still another form thereof, the present invention is directed to an imaging apparatus including a printhead carrier, a printhead mounted to the printhead carrier, and a printhead maintenance station including a printhead maintenance cap and a moving mechanism coupled to the printhead maintenance cap for moving the printhead maintenance cap relative to the printhead. The printhead maintenance cap includes a wall portion having a proximal end and a distal end, the wall portion defining an interior region. A first perimetrical lip extends from the distal end of the wall portion by a first extent, the first perimetrical lip defining a primary sealing surface. A second perimetrical lip extends from the distal end of the wall portion by a second extent, the second perimetrical lip being spaced apart from the first perimetrical lip, wherein a perimetrical valley is defined between the first perimetrical lip and the second perimetrical lip.

Another advantage of the present invention is that by having two sealing lips, the chances of providing an adequate seal with the topography of the printhead is increased.

Yet another advantage is the lip that first contacts the printhead can be more compliant than the second lip, thereby potentially reducing the capping force necessary to provide an adequate seal with the topography of the printhead.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one embodiment of the invention, in one form, and such exemplifications are not to be construed as limiting the scope of the invention in any manner.

DETAILED DESCRIPTION OF THE INVENTION

Figure 1:
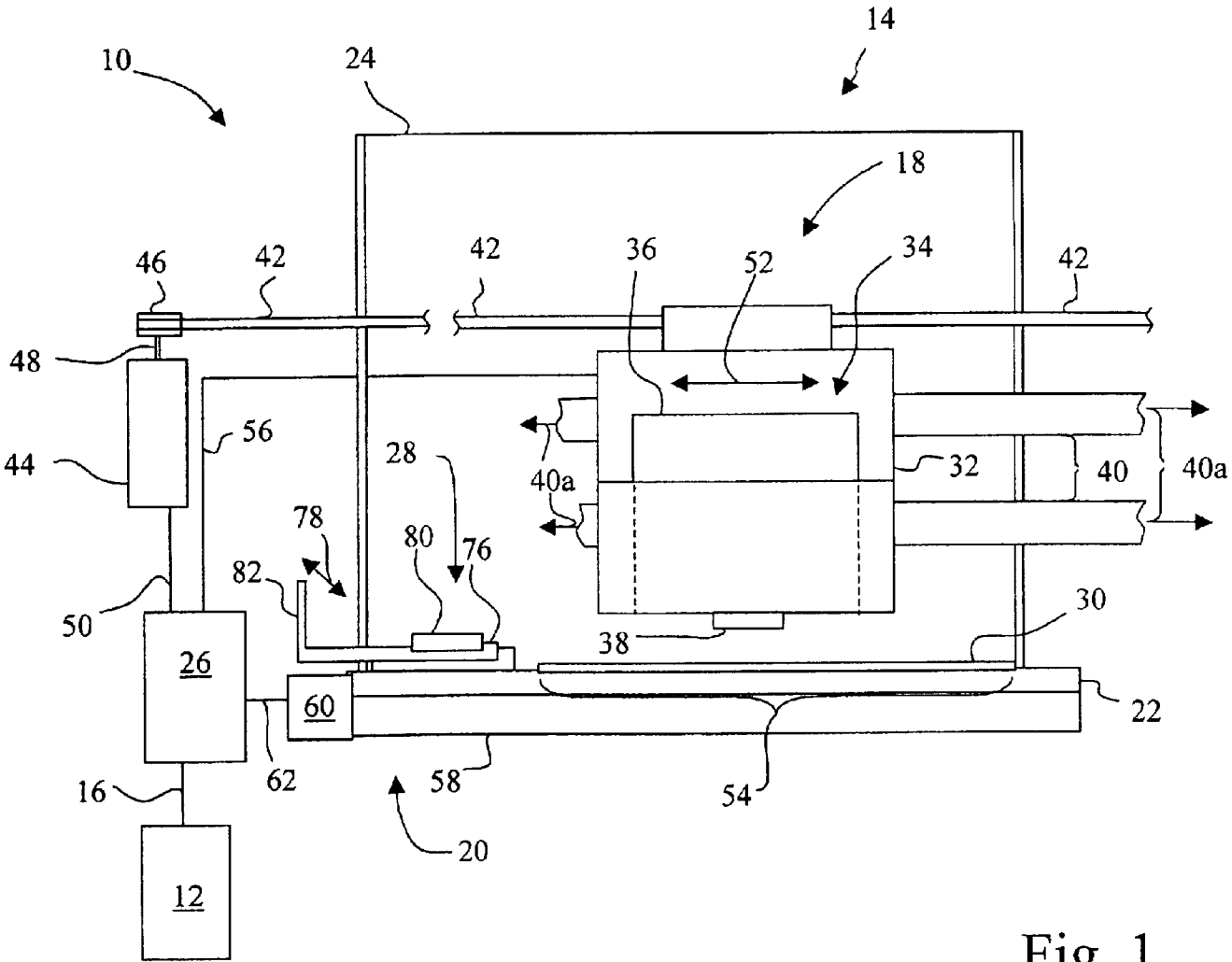
FIG. 1 is a diagrammatic representation of an ink jet printer employing an embodiment of the present invention.

Referring now to the drawings and more particularly to FIG. 1, there is shown an imaging system 10 embodying the present invention. Imaging system 10 includes a computer 12 and an imaging apparatus in the form of an ink jet printer 14. Computer 12 is communicatively coupled to ink jet printer 14 by way of communications link 16. Communications link 16 may be, for example, an electrical, an optical or a network connection.

Computer 12 is typical of that known in the art, and includes a display, an input device such as a keyboard, a processor and associated memory. Resident in the memory of computer 12 is printer driver software. The printer driver software places print data and print commands in a format that can be recognized by ink jet printer 14.

Ink jet printer 14 includes a printhead carrier system 18, a feed roller unit 20, a mid-frame 22, a media source 24, a controller 26 and a maintenance station 28.

Media source 24 is configured and arranged to supply from a stack of print media a sheet of print media 30 to feed roller unit 20, which in turn further transports the sheet of print media 30 during a printing operation.

Printhead carrier system 18 includes a printhead carrier 32 for carrying one or more printhead cartridges, such as a color printhead cartridge and/or monochrome printhead cartridge, that is mounted thereto. For convenience and ease of understanding the invention, a single printhead cartridge 34 is shown. Printhead cartridge 34 includes an ink reservoir 36 provided in fluid communication with an ink jet printhead 38.

Printhead carrier 32 is guided by a pair of guide rods 40. The axes 40*a* of guide rods 40 define a bidirectional-scanning path 52 of printhead carrier 32. Printhead carrier 32 is connected to a carrier transport belt 42 that is driven by a carrier motor 44 via a carrier pulley 46. Carrier motor 44 can be, for example, a direct current motor or a stepper motor. Carrier motor 44 has a rotating motor shaft 48 that is attached to carrier pulley 46. Carrier motor 44 is electrically connected to controller 26 via a communications link 50. At a directive of controller 26, printhead carrier 32 is transported, via the rotation of carrier pulley 46 imparted by carrier motor 44, in a reciprocating manner, back and forth along guide rods 40.

During a printing operation, the reciprocation of printhead carrier 32 transports ink jet printhead 38 across the sheet of print media 30 along bi-directional scanning path 52, i.e. a scanning direction, to define a print zone 54 of ink jet printer 14. Bi-directional scanning path 52, also referred to as scanning direction 52, is parallel with axes 40*a* of guide rods 40, and is also commonly known as the horizontal direction.

Ink jet printhead 38 is electrically connected to controller 26 via a communications link 56. Controller 26 supplies electrical address and control signals to ink jet printer 14, and in particular, to the ink jetting actuators of ink jet printhead 38, to effect the selective ejection of ink from ink jet printhead 38.

During each scan of printhead carrier 32, the sheet of print media 30 is held stationary by feed roller unit 20. Feed roller unit 20 includes a feed roller 58 and a drive unit 60.

During printing, the sheet of print media 30 is transported through print zone 54 by the rotation of feed roller 58 of feed roller unit 20. A rotation of feed roller 58 is effected by drive unit 60. Drive unit 60 is electrically connected to controller 26 via a communications link 62.

Figure 2:
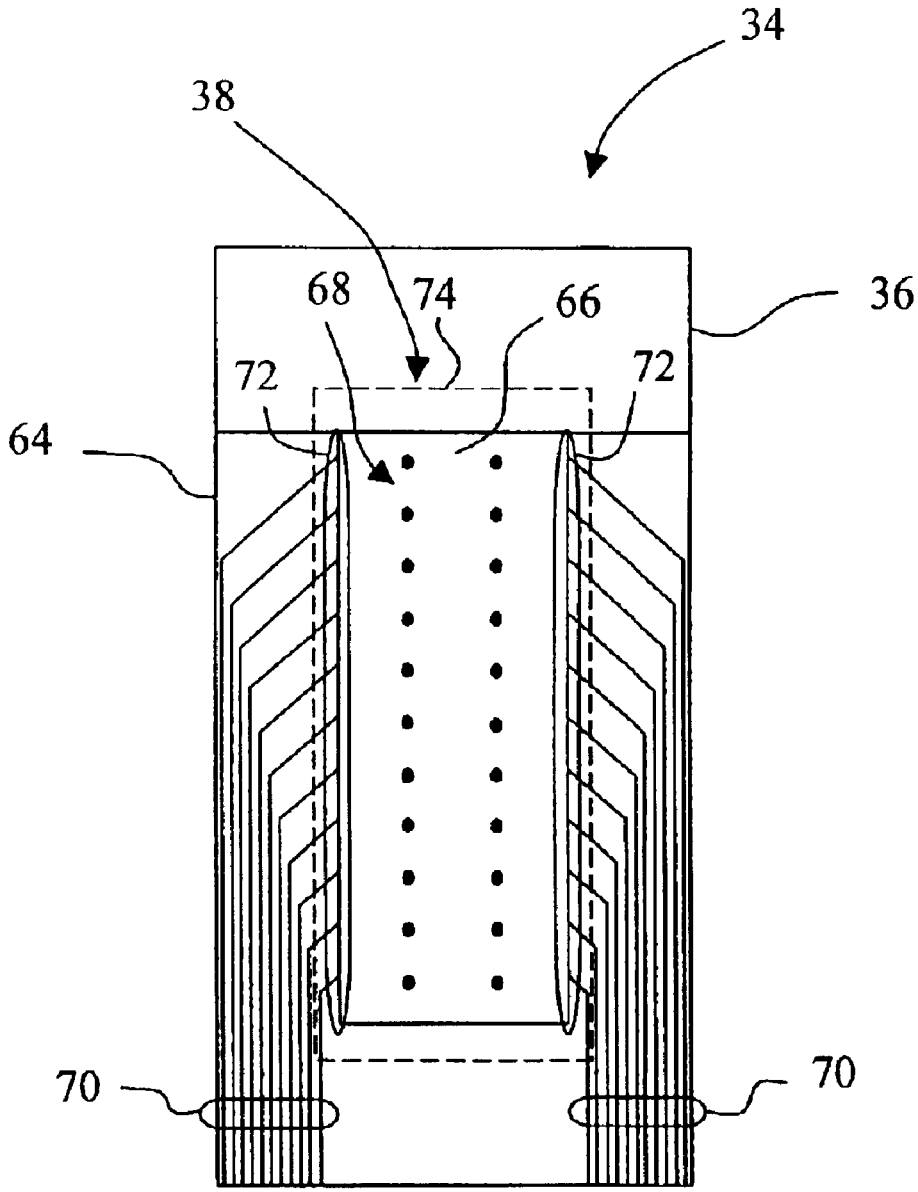
FIG. 2 is a greatly enlarged and simplified bottom plan view of the ink jet printhead used with the ink jet printer of FIG. 1.

FIG. 2 is a greatly enlarged and simplified bottom plan view of ink jet printhead 38. As shown, ink jet printhead 38 includes a tape automated bonded (TAB) circuit 64 and an ink jet nozzle plate 66. Ink jet nozzle plate 66 includes a plurality of ink jet nozzles 68 depicted by dots. TAB circuit 64 includes a plurality of electrical conductors 70 that are connected to controller 26 via communications link 56 and intervening circuitry, e.g. driver circuitry, (not shown), and are connected internally to individual ink jetting actuators (not shown), e.g., electric heaters, respectively associated with individual ones of ink jet nozzles 68. Ink jet nozzle plate 66 is attached to TAB circuit 64 by two elongate encapsulant beads 72. Accordingly, the topography of the region 74, depicted by a dashed box, surrounding ink jet nozzle plate 66 is irregular, i.e., non-planar, due to, for example, the presence of the two elongate encapsulant beads 72.

Referring again also to FIG. 1, maintenance station 28 is provided for performing printhead maintenance operations on ink jet nozzles 68 of ink jet printhead 38. Such operations include, for example, a printhead spit maintenance operation, a printhead wiping operation and a printhead maintenance capping operation. Other services, such as for example, printhead priming and suction, may also be performed if desired by the inclusion of a vacuum device (not shown) of the type well known in the art.

Maintenance station 28 includes a movable sled 76, of a type which is well known in the art, configured for movement in the directions generally depicted by double-headed arrow 78. The directions generally depicted by double-headed arrow 78 include both horizontal and vertical components. Mounted to movable sled 76 is a printhead maintenance cap 80 of the present invention.

Movable sled 76 includes a carrier engagement member 82. Movable sled 76 is biased by a spring (not shown) in a direction toward printhead carrier 32. As can be understood with reference to FIG. 1, as shown, a leftward movement of printhead carrier 32 causes printhead carrier 32 to engage carrier engagement member 82, thereby causing movable sled 76 to move to the left and upward, as illustrated by arrow 78, thereby raising printhead maintenance cap 80 toward a capping elevation with respect to ink jet printhead 38. When printhead maintenance cap 80 reaches the capping elevation, printhead maintenance cap 80 will have fully engaged ink jet printhead 38 of printhead cartridge 34, thereby providing a seal in the region 74 containing ink jet nozzle plate 66 and the associated ink jet nozzles 68.

Figure 3A:
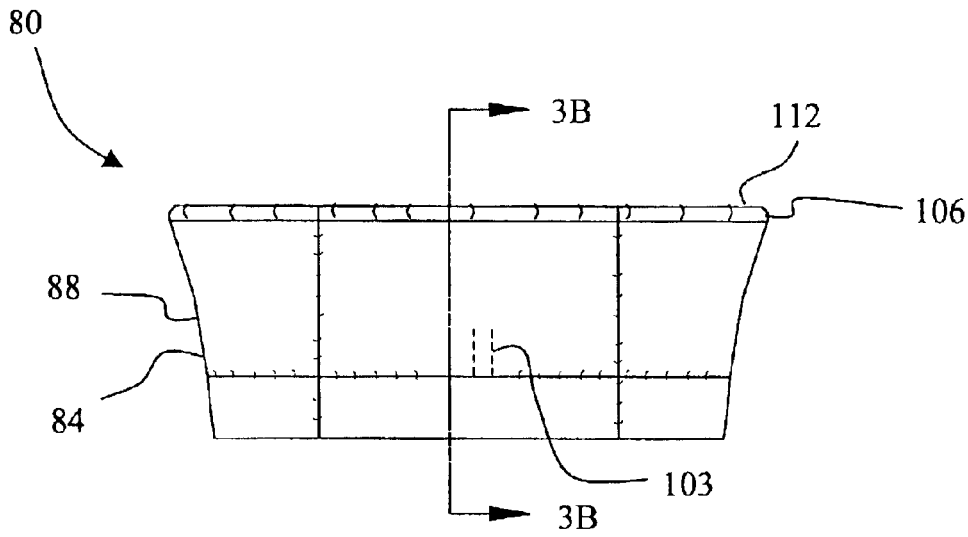
FIG. 3A is a side view of a printhead maintenance cap of the present invention.
Figure 3B:
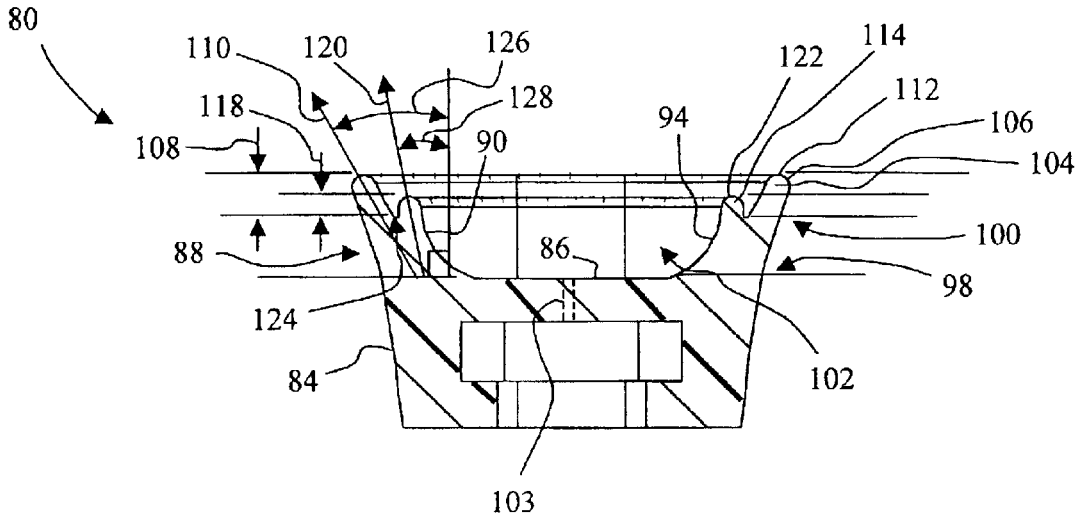
FIG. 3B is sectional view of the printhead maintenance cap of FIG. 3A.
Figure 3C:
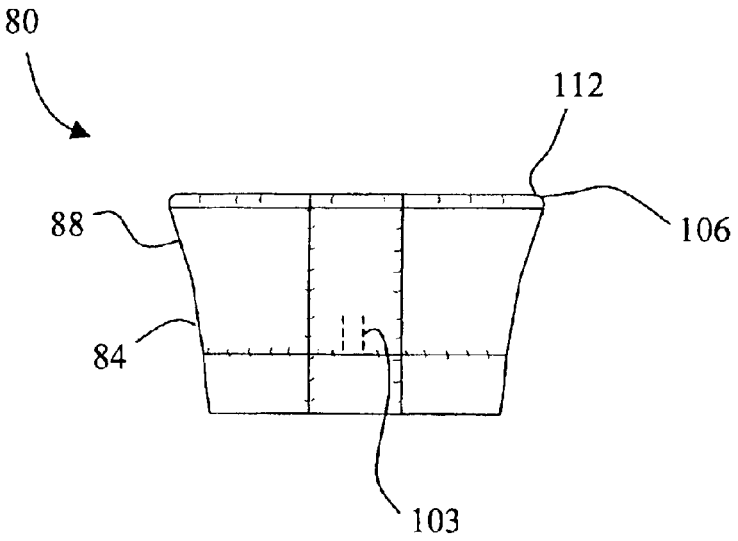
FIG. 3C is an end view of the printhead maintenance cap of FIG. 3A.

Referring to FIGS. 3A–3D, printhead maintenance cap 80 is a unitary cup-like structure made of an elastomer material, such as for example, Santoprene 111-45, available from Monsanto. As best illustrated in FIG. 3B, printhead maintenance cap 80 includes a base 84 including a floor 86, and a wall portion 88 having a proximal end 98 and a distal end 100. Wall portion 88 is defined by a plurality of adjoining walls 90, 92, 94 and 96. Proximal end 98 is adjacent to and coupled to base 84. Wall portion 88, i.e., walls 90, 92, 94, 96, define an interior region 102. As shown, wall portion 88 extends generally in a direction non-orthogonal to base 84. Optionally, as shown by dashed lines, base 84 may include an opening 103 that extends from interior region 102 to an exterior region relative to printhead maintenance cap 80 to provide venting from interior region 102 to the atmosphere.

Figure 3D:
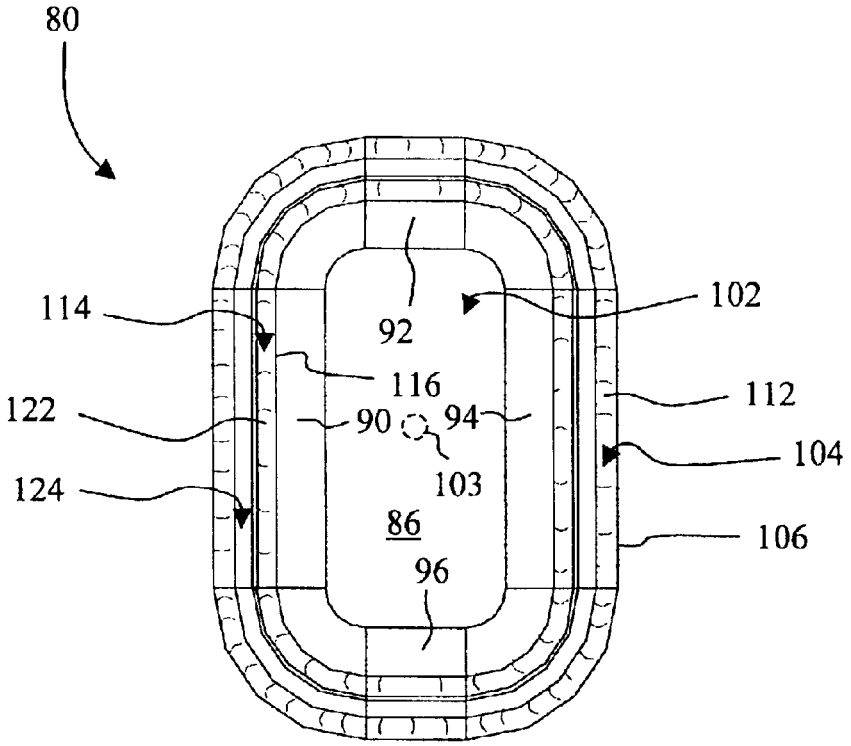
FIG. 3D is a top plan view of the printhead maintenance cap of FIG. 3A.

Referring now particularly to FIGS. 3B and 3D, a first lip 104 extends around an outer perimeter 106 of printhead maintenance cap 80, and thus is sometimes referred to as a first perimetrical lip. Further, first lip 104 extends from distal end 100 of wall portion 88 by a first extent 108 in a cantilever manner in a direction 110 that is non-orthogonal to floor 86 of base 84. First lip 104 defines a first perimetrical sealing surface 112. First perimetrical sealing surface 112 serves as a primary perimetrical sealing surface for printhead maintenance cap 80.

A second lip 114 extends around an inner perimeter 116 of printhead maintenance cap 80, and thus is sometimes referred to as a second perimetrical lip. Further, second lip 114 extends from distal end 100 of wall portion 88 by a second extent 118 in a direction 120 that is non-orthogonal to floor 86 of base 84. Second lip 104 defines a second perimetrical sealing surface 122. Second lip 114 is spaced apart from first lip 104. Second perimetrical sealing surface 122 serves as a secondary perimetrical sealing surface for printhead maintenance cap 80. A perimetrical valley 124 is defined between first lip 104 and said second lip 114.

Printhead maintenance cap 80 provides a configuration due to the positional relationship of first lip 104 with respect to second lip 114 and perimetrical valley 124 such that, as the contact force between first lip 104 and ink jet printhead 38 increases, second lip 114 limits an amount of flexure of first lip 104 as first lip 104 pulls against second lip 114, and further limits an amount of flexure of first lip 104 when second lip 114 contacts ink jet printhead 38. As shown in FIG. 3B, an angle 126 of departure of direction 110 of first lip 104 from orthogonal is greater than an angle 128 of departure of direction 120 of second lip 114 from orthogonal. Also, second, i.e., secondary, perimetrical sealing surface 122 of lip 114 is positioned closer to base 84 than first, i.e., primary, perimetrical sealing surface 112 of lip 104. As such, first extent 108 is greater than second extent 118, such that first lip 104 is capable of greater flexure, i.e., deflection, from its resting position than is second lip 114. Stated another way, since first extent 108 is greater than second extent 118, and since angle 126 is greater than angle 128, the first perimetrical lip 104 is more compliant than the second perimetrical lip 114.

During a printhead capping maintenance operation, printhead maintenance cap 80 is moved by movable sled 76 (FIG. 1) to engage ink jet printhead 38. At this time, first lip 104 (FIGS. 3B and 3D) contacts ink jet printhead 38 at region 74 (FIG. 2), and may contact uneven surfaces resulting from either or both of encapsulant beads 72, TAB circuit 64 and/or ink jet nozzle plate 66. Due to the respective extents 108, 118 of first lip 104 and second lip 114, first lip 104 contacts ink jet printhead 38 before second lip 114, thereby resulting in a flexure of first lip 104. As printhead maintenance cap 80 is further moved toward ink jet printhead 38, second lip 114 contacts ink jet printhead 38 near region 74 at a region interior to that of first lip 104. As second lip 114 contacts ink jet printhead 38, second lip 114 acts as a dampened stop to limit an amount of the flexure of first lip 104. The configuration and extents of first and second lips 104, 114 and perimetrical valley 124 are empirically selected such that at least one of first perimetrical sealing surface 112 and second perimetrical sealing surface 122 will fully engage ink jet printhead 38 to seal the region 74 surrounding ink jet nozzles 68 of ink jet nozzle plate, notwithstanding the irregular topography of region 74, when printhead maintenance cap 80 is at the final capping elevation.

Thus, printhead maintenance cap 80 provides a relatively high compliance first lip 104, which thereby lowers the capping force required to be exerted relative to printhead maintenance cap 80 and ink jet printhead 38 to obtain an adequate seal between ink jet printhead 38 and primary perimetrical sealing surface 112 of printhead maintenance cap 80, while further providing a relatively lower compliance second lip 114 that serves to limit the flexure of first lip 104 and to provide a secondary perimetrical sealing surface 122 to enhance the sealing capability provided by printhead maintenance cap 80. Traditional cap systems typically need 150 grams to 300 grams of capping force to obtain adequate compliance of the printhead cap and sealing of a printhead. In contrast, printhead maintenance cap 80 permits effective sealing with about 100 grams or less of capping force.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A printhead maintenance cap, comprising:

a base;

a wall portion defined by a plurality of adjoining walls, and having a proximal end and a distal end, said plurality of adjoining walls defining an interior region, said proximal end being coupled to said base; and a first lip extending from said distal end of said wall portion by a first extent in a direction non-orthogonal to said base, said first lip defining a first perimetrical sealing surface; and a second lip extending from said distal end of said wall portion by a second extent, said second lip being spaced apart from said first lip, said second lip defining a second perimetrical sealing surface.

2. The printhead maintenance cap of claim 1, wherein said first perimetrical sealing surface is a primary perimetrical sealing surface and said second perimetrical sealing surface is a secondary perimetrical sealing surface, said secondary perimetrical sealing surface being positioned closer to said base than said primary perimetrical sealing surface.

3. The printhead maintenance cap of claim 1, wherein a perimetrical valley is defined between said first lip and said second lip.

4. The printhead maintenance cap of claim 1, wherein said first extent is greater than said second extent, such that said first lip is capable of greater flexure than said second lip.

5. The printhead maintenance cap of claim 4, being configured such that said second lip limits an amount of flexure of said first lip.

6. The printhead maintenance cap of claim 1, wherein said wall portion extends generally in said direction non-orthogonal to said base.

7. The printhead maintenance cap of claim 1, wherein said base includes an opening that extends from said interior region to an exterior region relative to said printhead maintenance cap.

8. A printhead maintenance cap, comprising:

a wall portion having a proximal end and a distal end, said wall portion defining an interior region; and a first perimetrical lip extending from said distal end of said wall portion by a first extent, said first perimetrical lip defining a primary sealing surface; and a second perimetrical lip extending from said distal end of said wall portion by a second extent, said second perimetrical lip being spaced apart from said first perimetrical lip, wherein a perimetrical valley is defined between said first perimetrical lip and said second perimetrical lip.

9. The printhead maintenance cap of claim 8, wherein said second perimetrical lip defines a secondary sealing surface.

10. The printhead maintenance cap of claim 8, wherein said first extent is greater than said second extent, such that said first perimetrical lip is more compliant than said second perimetrical lip.

11. The printhead maintenance cap of claim 8, being configured such that said second perimetrical lip limits an amount of flexure of said first perimetrical lip.

12. An imaging apparatus, comprising:

a printhead carrier;

a printhead mounted to said printhead carrier; and a printhead maintenance station including a printhead maintenance cap and a moving mechanism coupled to said printhead maintenance cap for moving said printhead maintenance cap relative to said printhead, said printhead maintenance cap comprising:

a base;

a wall portion defined by a plurality of adjoining walls, and having a proximal end and a distal end, said plurality of adjoining walls defining an interior region, said proximal end being coupled to said base; and a first lip extending from said distal end of said wall portion by a first extent in a direction non-orthogonal to said base, said first lip defining a first perimetrical sealing surface; and a second lip extending from said distal end of said wall portion by a second extent, said second lip being spaced apart from said first lip, said second lip defining a second perimetrical sealing surface.

13. The imaging apparatus of claim 12, wherein when said printhead maintenance cap is moved to engage said printhead, said first lip contacts said printhead before said second lip causing a flexure of said first lip, and upon said second lip contacting said printhead said second lip limiting an amount of said flexure of said first lip.

14. The imaging apparatus of claim 12, wherein said first perimetrical sealing surface is a primary perimetrical sealing surface and said second perimetrical sealing surface is a secondary perimetrical sealing surface, said secondary perimetrical sealing surface being positioned closer to said base than said primary perimetrical sealing surface.

15. The imaging apparatus of claim 12, wherein a perimetrical valley is defined between said first lip and said second lip.

16. The imaging apparatus of claim 12, wherein said first extent is greater than said second extent, such that said first lip is capable of greater flexure than said second lip.

17. The imaging apparatus of claim 16, being configured such that said second lip limits an amount of flexure of said first lip.

18. The imaging apparatus of claim 12, wherein said wall portion extends generally in said direction non-orthogonal to said base.

19. The imaging apparatus of claim 12, wherein said base includes an opening that extends from said interior region to an exterior region relative to said printhead maintenance cap.

20. An imaging apparatus, comprising:

a printhead carrier;

a printhead mounted to said printhead carrier; and a printhead maintenance station including a printhead maintenance cap and a moving mechanism coupled to said printhead maintenance cap for moving said printhead maintenance cap relative to said printhead, said printhead maintenance cap comprising:

a wall portion having a proximal end and a distal end, said wall portion defining an interior region; and a first perimetrical lip extending from said distal end of said wall portion by a first extent, said first perimetrical lip defining a primary sealing surface; and a second perimetrical lip extending from said distal end of said wall portion by a second extent, said second perimetrical lip being spaced apart from said first perimetrical lip, wherein a perimetrical valley is defined between said first perimetrical lip and said second perimetrical lip.

21. The imaging apparatus of claim 20, wherein when said printhead maintenance cap is moved to engage said printhead, said first perimetrical lip contacts said printhead before said second perimetrical lip causing a flexure of said first perimetrical lip, and upon said second perimetrical lip contacting said printhead said second perimetrical lip limiting an amount of said flexure of said first perimetrical lip.

22. The imaging apparatus of claim 20, wherein said second perimetrical lip defines a secondary sealing surface.

23. The imaging apparatus of claim 20, wherein said first extent is greater than said second extent, such that said first perimetrical lip is more compliant than said second perimetrical lip.

24. The imaging apparatus of claim 20, being configured such that said second perimetrical lip limits an amount of flexure of said first perimetrical lip.

* * * * *